US007340981B1

(12) United States Patent
Walter

(10) Patent No.: US 7,340,981 B1
(45) **Date of Patent: *Mar. 11, 2008**

(54) ANGLED AND OFFSET DRIVE RATCHET EXTENSION

(76) Inventor: Bryce Walter, P.O. Box #40, Union Street, Modena, PA (US) 19358

( * ) Notice: Subject to any disclaimer, the term of this patent is extended or adjusted under 35 U.S.C. 154(b) by 0 days.

This patent is subject to a terminal disclaimer.

(21) Appl. No.: 11/220,779

(22) Filed: Sep. 7, 2005

(51) Int. Cl.
*B25B 17/00* (2006.01)
*B25B 23/16* (2006.01)

(52) U.S. Cl. ..... 81/57.29; 81/177.2

(58) Field of Classification Search ..... 81/57.29, 81/57.28, 57.13, 57.22, 177.2
See application file for complete search history.

(56) References Cited

U.S. PATENT DOCUMENTS 1,333,532 A * 3/1920 Berk ..... 81/57.29
1,494,200 A * 5/1924 Waters ..... 81/57.29
4,376,397 A * 3/1983 Newby et al. ..... 81/177.2
4,453,433 A * 6/1984 Clement ..... 81/57.29
4,813,308 A * 3/1989 Petrus ..... 81/57.29
4,913,007 A * 4/1990 Reynolds ..... 81/57.29
6,009,776 A * 1/2000 Warren ..... 81/57.29
6,216,562 B1 * 4/2001 Hsieh ..... 81/57.29

* cited by examiner

*Primary Examiner*—Hadi Shakeri
(74) *Attorney, Agent, or Firm*—Michael F. Petock, Esq.; Petock & Petock, LLC

(57) ABSTRACT

A tool is provided in the form of an angled and/or offset ratchet wrench extension. The angles may be selected, but in a preferred embodiment, a ratchet extension provides a right angle drive. The tool comprises a socket driver that is adapted to be connected to a socket and a rotatable drive shaft rotatably mounted within a housing. A first direction changing transmission is provided near the end for converting the rotatable drive shaft motion to rotary motion to drive the socket driver at the specified angle. A ratchet wrench is connected to the distal portion of the rotary drive shaft. In a second embodiment, a second direction changing transmission is located near the distal portion of the rotatable drive shaft for converting the rotary motion of a ratchet wrench to the rotary motion of the rotatable drive shaft. The length of the extension may be adjustable.

7 Claims, 3 Drawing Sheets

64
84
66
62
78
68
72
70
77
60
80
92
90
108
76
94
88
106
102
104
74
86
4
4
70
72
76
100
86
88
98
96

ANGLED AND OFFSET DRIVE RATCHET EXTENSION

FIELD OF THE INVENTION

The present invention relates to an angled and offset drive ratchet extension. More particularly, the present invention in a preferred embodiment relates to a right angled and offset parallel drive ratchet extension.

BACKGROUND OF THE INVENTION

Often times in the repair of machinery, fasteners such as nuts and bolts need to be removed and replaced in locations which are difficult to access. This is more particularly a problem today where a significant amount of equipment is compactly mounted in a small space. One example of this is engines on modern automotive vehicles including trucks and automobiles. However, this problem arises in other areas where much equipment is packed into a small area, often making it difficult to access adjustments and fasteners which need to be adjusted, removed and replaced for repairs and/or other purposes.

SUMMARY OF THE INVENTION

An advantage of the present invention is that it enables fasteners and the like by means of a socket wrench to be accessed at a remote location and at various angles, including zero angle and offset parallel.

Another advantage of the present invention is that it may provide access to a fastener, adjustment or the like via a socket remotely and at a right angle.

Another advantage of the present invention is that it may provide access to a fastener, adjustment or the like by means of a socket which may be offset a specified distance in parallel direction.

Another advantage of the present invention is that the length of the socket extension may be varied or adjusted.

Briefly and basically, in accordance with the present invention, a tool comprises a socket driver that is adapted to be connected to a socket. A rotatable drive shaft having a proximal and distal portion is rotatably mounted within a housing. The drive shaft and the housing may be at an angle to the axis of rotation of the socket driver. In a presently preferred embodiment, this angle may be a right angle or perpendicular. A first direction changing transmission means is provided near the proximal portion of the rotatable drive shaft for converting rotary motion of the rotatable drive shaft to rotary motion to drive the socket driver at the specified angle. Means is provided near the distal portion of the rotary drive shaft for connecting the rotatable drive shaft to a socket driver of a socket ratchet wrench.

In a second embodiment of the present invention, a second direction changing transmission means is located near the distal portion of the rotatable drive shaft for converting the rotary motion of the socket driver to the rotatable drive shaft which is positioned at a second angle with respect to the socket driver. The second angle may be the same as the first angle. In a presently preferred embodiment, both the first angle and the second angle may be right angles resulting in a parallel offset drive.

Additionally, any of the embodiments of the present invention may be provided with adjustability of the length of the extension. The drive shaft may be comprised of two parts, one which fits into the other, with the outer surface of the inner drive shaft being non-round and the inner surface of the outer drive shaft being non-round in a mating fashion. In a presently preferred embodiment, the mating portions of the drive shaft may be splined. The housing of the drive shaft is also adjustable by means of two members, one slidably fitting within the other. The housing need not be non-round or splined to prevent rotation, but may be non-round or provided with a detent or pin or other mechanism to prevent rotation of one section with respect to the other. Detent mechanisms may also be provided to limit the amount of extension to prevent separation of the parts.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figures 1, 2:
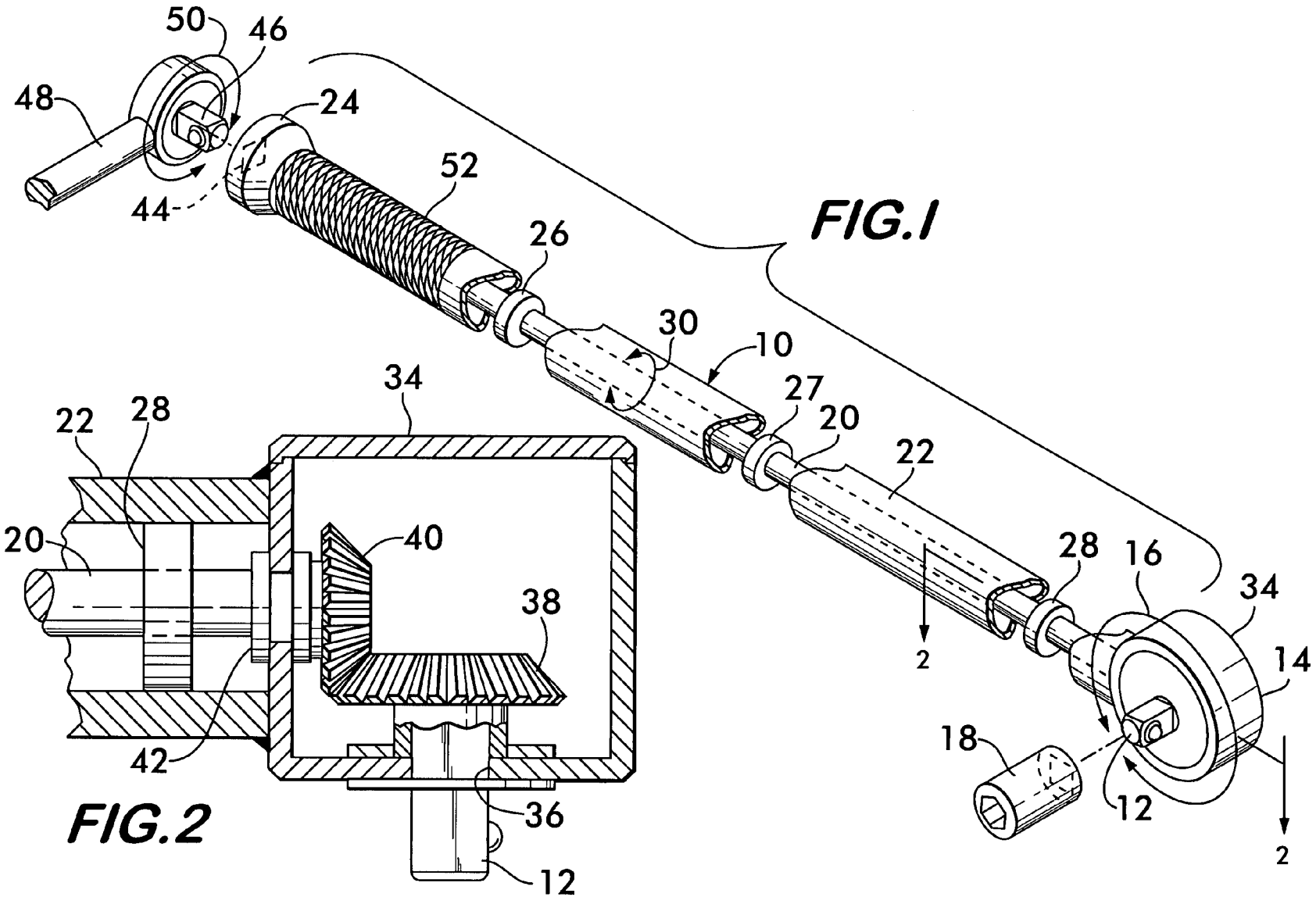
FIG. 1 is a view in perspective, partially broken away, of an embodiment of the present invention.
FIG. 2 is a cross sectional view taken along line 2-2 of FIG. 1.

Referring now to the drawings wherein like numerals indicate like elements, there is shown in FIG. 1 one embodiment of tool 10 in accordance with the present invention. Tool 10 includes a socket driver 12 mounted on or near a proximal end 14 of tool 10. Socket driver 12 can rotate in two rotational directions as illustrated by double headed arrow 16. Socket driver 12 is adapted to connect to a socket 18 which is used to engage a fastener or the like which is to be adjusted, tightened or loosened by use of the tool in connection with a ratchet wrench. Although socket 18 is illustrated as being a socket of the conventional type which surrounds the periphery of a nut or bolt having a hexagonal, square or other similar shape, it is understood that socket 18 includes any type of instrument which engages a fastener which includes the torx, allen head, phillips head and various other types of known and to be developed connections between a fastener head and a tool. Throughout the specification and claims, the word socket includes this broad definition of all types of tools or instruments which may be used as a connection between the socket driver of a ratchet wrench and a fastener, adjustment or other similar hardware.

Tool 10 includes a rotatable drive shaft 20 mounted within a housing 22. Rotatable drive shaft 20 has a proximal end near 14 and a distal end near 24. Drive shaft 20 may be mounted on bushings 26, 27 and 28 or other suitable support structure within housing 22. Drive shaft 20 is adapted to rotate in two directions as indicated by double headed arrow 30. Drive shaft 20 and housing 22 are mounted at an angle to the axis of rotation of socket driver 12. This angle may be selected as desired and may include any suitable angle from zero to well over 90 degrees, such as 135 degrees. However, in a presently preferred embodiment as illustrated in FIG. 1, the angle between drive shaft 20 and its housing on the one hand and the axis of rotation of socket driver 12 is preferably approximately 90 degrees.

The change of direction of the rotary motion of drive shaft 20 to the substantially perpendicular or other angled direction of rotation of socket driver 12 is accomplished by a first direction changing transmission means 34. The first direction changing transmission means 34 is provided near the proximal portion of the rotatable drive shaft and converts the rotary motion of the rotatable drive shaft to rotary motion to drive the socket driver 12 at the specified angle, which in the preferred embodiment is 90 degrees. Any suitable structure may be utilized to convert rotary motion in one direction to rotary motion in another direction, but one presently preferred embodiment is beveled gears as illustrated by the cross sectional view shown in FIG. 2 taken along line 2-2 of FIG. 1.

As shown in FIG. 2, socket driver 10 may be journaled in the housing of first direction changing transmission means 34 at 36. The inner end of socket driver 12 is provided with a beveled gear 38. Beveled gear 38 meshes with beveled gear 40. Beveled gears 38 and 40 may be provided with other angles to accommodate angles between the axis of rotation of drive shaft 20 and the axis of rotation of socket driver 12 at angles other than 90 degrees. Beveled gear 40 is connected to proximal end of drive shaft 20. Proximal end of drive shaft 20 is journaled in first direction changing means 34 housing at 42.

Means 44 is provided near the distal portion of the rotary drive shaft 20 for connecting the rotatable drive shaft 20 to a socket driver 46. Connecting means 44 may be any suitable means for connecting the socket driver of a socket ratchet wrench to drive shaft 20, and in a presently preferred embodiment is a recess in the shape of the socket driver of the ratchet wrench connected to the distal end of drive shaft 20. As is conventional and well known, socket ratchet wrench 48 may be used to drive socket driver 46 in either two rotational directions by a switching or selection means contained on the ratchet wrench (not shown). The two directions for rotation are illustrated by double headed arrow 50.

Drive shaft housing 22 may be provided with a knurling 52 or other gripping surface to enhance the ability to grip housing 22.

Figures 3, 4:
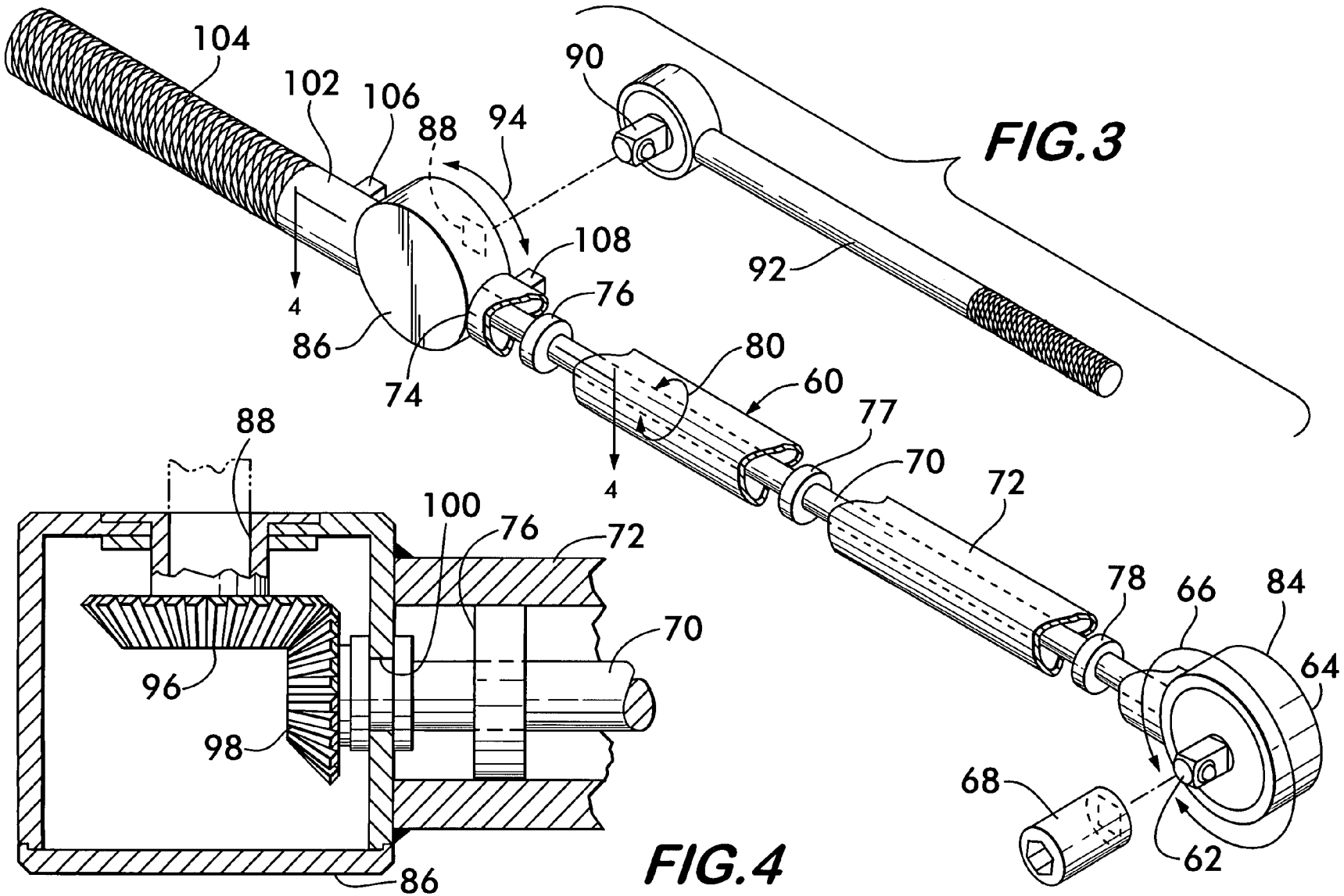
FIG. 3 is a view in perspective, partially broken away, of another embodiment of the present invention illustrating two direction changing transmission means.
FIG. 4 is a cross sectional view taken along line 4-4 of FIG. 3.

Referring now to FIG. 3, there is shown another embodiment of the present invention which comprises a tool 60 for rotating a socket driver 62 located at or near proximal end 64. Socket driver 62 is adapted to rotate in two rotational directions as shown by double headed arrow 66. Socket driver 62 is adapted to connect to socket 68 for tightening or loosening a fastener of any of the various types. As discussed above, socket 68 may be of any type of fastener connecting device currently used or to be developed in the future. Socket driver 62 is driven by drive shaft 70 mounted in drive shaft housing 72. Drive shaft 70 extends from near proximal end 64 to its distal end 74. Drive shaft 70 may be mounted in drive shaft housing 72 by means of bushings 76, 77 and 78 or any other suitable mounting means. The rotary motion of drive shaft 70 is converted to motion at an angle in the direction of rotation of socket driver 62 by first direction changing transmission means 84. Drive shaft 70 can rotate in two rotational directions as indicated by double headed arrow 80. First direction changing transmission means 84 operates in the same manner as previously described with respect to first direction changing transmission means 34 of FIG. 1 and as described with respect to FIG. 2. As described with respect to the embodiment of FIG. 1, the direction changing transmission means may provide change of direction to various suitable angles between the drive shaft and the socket driver, but in a presently preferred embodiment, these direction changes would be 90 degrees or at a right angle.

The embodiment shown in FIG. 3 contains a second direction changing transmission means 86. Second direction changing transmission means 86 operates in a manner similar to first direction changing transmission means 34 and 84 and may be at various suitable angles, but in a presently preferred embodiment, the angle would be 90 degrees or perpendicular. Second direction changing transmission means is located near the distal portion 74 of drive shaft 70 and converts the rotary motion of socket connecting means 88 and socket driver 90 to rotary motion of the axis of rotation of rotatable drive shaft 70. As illustrated in FIG. 3, both first and second direction changing transmission means 84 and 86 may be adapted to convert rotary motion by the same angle, that is both at right angles, or they may be different. In other words, one of them could be at a 45 degree angle and the other at a 90 degree angle. There is no need for the first and second direction changing transmission means to convert the motion by the same number of degrees of angularity.

As illustrated in FIG. 3, socket driver 90 is part of socket ratchet wrench 92 which may selectably drive in two rotational directions. These two rotational directions are indicated by double headed arrow 94.

Second direction changing transmission means 86 is similar to the structure of first direction changing transmission means 84, and is illustrated in the cross sectional view shown in FIG. 4 which is taken along line 4-4 of FIG. 3. The connecting means 88 for socket driver 90 of ratchet wrench 92 is journaled in the housing of second direction changing transmission means 86 and is connected to beveled gear 96. Beveled gear 96 is adapted to mesh with bevel gear 98 which drives drive shaft 70 which is journaled at 100 in the housing of second direction changing transmission means 86.

Tool 60 may be provided with knurling on the outer surface of housing 72 as was illustrated with respect to FIG. 1 or it may be provided with an extension handle 102 with knurling 104 thereon. In other words, handle 102 is provided distally of the second direction changing transmission means 86.

Tool 60 may also be provided with stops 106 and 108 which may be used to limit the amount of motion of socket ratchet wrench 92, preventing the handle of ratchet wrench 92 from passing by handle 102, possibly causing injury to the hand or fingers of a hand holding handle 102.

Figure 5:
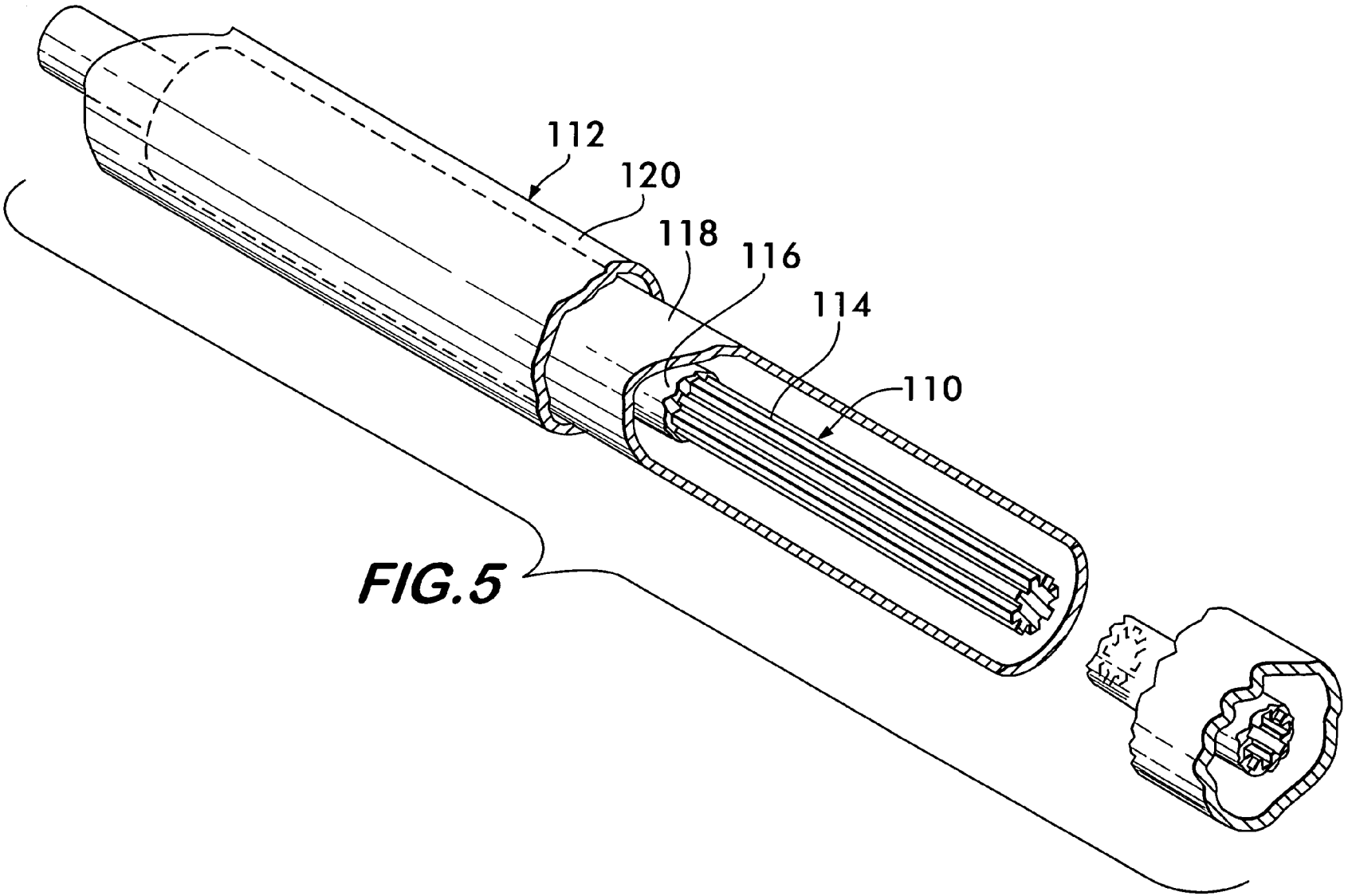
FIG. 5 is a view in perspective, partially broken away, of another embodiment of the present invention wherein the ratchet extension tool of the present invention is of adjustable length.

FIG. 5 is a view in perspective, partially broken away, showing an adjustable length of the drive shaft and the housing to provide a tool of adjustable length for use in connection with the embodiments of either FIG. 1 or 3. Accordingly, FIG. 5 illustrates an embodiment wherein the length of the rotatable drive shaft 110 and the housing 112 is adjustable. Drive shaft 110 may be comprised of a first section 114 referred to sometimes as the inner drive shaft and a second or outer drive shaft 116 sometimes referred to as the outer drive shaft. Any suitable non-round surface on the surface of first or inner drive shaft 114 may mate with a corresponding non-round surface on the inner surface of the outer drive shaft 116. These may include any of various shapes including oval, square, hexagon, octagon, decagon or any other suitable shape. A presently preferred embodiment as illustrated in FIG. 3 is to have the inner and outer shafts 114 and 116 splined. In other words, mating splines would be formed on the outer surface of inner shaft 114 and on the inner surface of outer shaft 116.

Housing 112 may also be comprised of an inner section 118 and an outer section 120. Inner section 118 may merely slide within outer section 120. The outer section may be provided with a detent mechanism to prevent inner section 18 from rotating with respect to outer section 120, or they would be allowed to rotate freely. The detent mechanism may be any groove in one with the pin projecting from the other. In other words, the inner housing section 118 may include a slot and the outer section 120 may include a pin projecting inwardly into the slot. The pin in a slot would prevent rotation of inner section 118 and outer section 120 with respect to each other, and also may be used as a detent or stop mechanism to limit the amount of extension and prevent the tool from coming apart. Various other types of detent or stop mechanisms may be used including flared ends and the like. Housing 112 comprised of inner section 118 and outer section 120 may also be constructed of various shapes in cross section including various non-round shapes such as oval, square, hexagon, octagon, decagon or any other suitable shape. Any non-round shape would automatically prevent rotation of one section of the housing with respect to the other.

In this manner, the length of the tool may be adjusted at will as desired to lengthen or shorten the tool to reach more distant locations or make the tool more compact or shorter for ease of use.

The present invention may be embodied in other specific forms without departing from the spirit or essential attributes thereof and, accordingly, reference should be made to the appended claims, rather than to the foregoing specification as indicating the scope of the invention.

I claim:

1. A tool comprising:

an elongated housing having a proximal and a distal end;

a first direction changing transmission mounted near said proximal end;

a socket drive connection on said first direction changing transmission wherein said socket drive connection is substantially perpendicular to a longitudinal axis of said elongated housing;

an elongated handle formed as a part of the distal end of the elongated housing for holding the tool, said elongated handle having sufficient length to be grasped by a hand;

a second direction changing transmission mounted in said elongated housing proximally of said handle;

a ratchet wrench connection on said second direction changing transmission adapted to provide connection to a ratchet wrench with the axis of rotation of said ratchet wrench connection being parallel to and offset from said socket drive connection of said first direction changing transmission;

drive structure contained within said elongated housing between said first direction changing transmission and said second direction changing transmission for transmitting force from said ratchet wrench to said socket drive connection;

said portion of said elongated housing between said first direction changing transmission and said second direction changing transmission being longer than said handle; and stops provided on said housing to prevent rotation of said ratchet wrench past said housing.

2. A tool in accordance with claim 1 wherein said drive structure contained within said elongated housing is a drive shaft and said first and second direction changing transmissions are comprised of beveled gears.

3. A tool in accordance with claim 1 wherein said elongated handle is provided with a knurled surface.

4. A tool in accordance with claim 1 wherein the length of said elongated housing and said drive structure are adjustable in length.

5. A tool in accordance with claim 4 wherein said drive structure is comprised of a rotatable drive shaft comprised of a first and a second splined shaft, one portion being slidable insertable in the other.

6. A tool in accordance with claim 5 wherein said housing is comprised of first and second tubular members, said first and second tubular members being slidably insertable one into the other.

7. A tool in accordance with claim 4 wherein said drive structure is a rotatable drive shaft adjustable in length and is comprised of first and second drive shafts, the first being slidably insertable into the second, wherein the outer surface of the portion of the first drive shaft that slides into the second is non round and wherein the inner portion of the second drive shaft it slides into is matingly non round.

* * * * *